US011241069B2

(12) United States Patent
Wadaywa

(10) Patent No.: US 11,241,069 B2
(45) Date of Patent: Feb. 8, 2022

(54) CUSTOMIZABLE BAG ORGANIZER

(71) Applicant: Charles Ogutu Wadaywa, Vaughan (CA)

(72) Inventor: Charles Ogutu Wadaywa, Vaughan (CA)

( * ) Notice: Subject to any disclaimer, the term of this patent is extended or adjusted under 35 U.S.C. 154(b) by 363 days.

(21) Appl. No.: 16/532,904

(22) Filed: Aug. 6, 2019

(65) Prior Publication Data

US 2020/0037721 A1 Feb. 6, 2020

Related U.S. Application Data

(60) Provisional application No. 62/714,879, filed on Aug. 6, 2018.

(51) Int. Cl.
*A45C 13/02* (2006.01)
*A45C 13/00* (2006.01)

(52) U.S. Cl.
CPC ..... *A45C 13/02* (2013.01); *A45C 13/001* (2013.01); *A45C 2013/026* (2013.01)

(58) Field of Classification Search
CPC .. A45C 13/02; A45C 13/001; A45C 2013/026
See application file for complete search history.

(56) References Cited

U.S. PATENT DOCUMENTS 1,674,352 A * 6/1928 Adams ..... F41C 33/06 206/317
1,711,030 A * 4/1929 Pifer ..... A47F 5/005 312/140
2,161,624 A * 6/1939 Hoerr ..... A21B 3/135 220/551
3,067,903 A * 12/1962 Jones, Jr. ..... A47F 5/005 220/552
5,873,504 A * 2/1999 Farmer ..... A45F 3/00 224/576
6,073,794 A * 6/2000 Bidot ..... A47B 88/975 220/529
6,640,944 B2 * 11/2003 Adams ..... A45C 7/0077 150/113
10,336,504 B2 * 7/2019 Prezecki, II ..... B65D 25/06
11,090,127 B2 * 8/2021 Oko ..... A61L 2/26

* cited by examiner

*Primary Examiner* — Tri M Mai

(57) ABSTRACT

A customizable bag organizer is an apparatus that organizes and supports the structure of a bag. The apparatus includes at least one organizing mechanism. The at least one organizing mechanism includes a central rod and a plurality of telescopic dividers. The central rod connects each telescopic divider. Each telescopic divider includes a fixed panel, a free panel, at least one first track and at least one second track. The apparatus includes a base plate to uphold items within each compartment defined by the plurality of telescopic dividers. In order to easily see within each compartment, the apparatus includes at least one light source, a light sensor, a portable power source, and a switch. The items within a bag are removed while maintaining the desired positions within each compartment as the apparatus includes a supplementary pouch. The supplementary pouch upholds the items, the central rod, and the plurality of telescopic dividers.

19 Claims, 10 Drawing Sheets

CUSTOMIZABLE BAG ORGANIZER

The current application claims priority to U.S. provisional application Ser. No. 62/714,879 filed on Aug. 6, 2018.

FIELD OF THE INVENTION

The present invention generally relates to organizers. More specifically, the present invention is a customizable bag organizer.

BACKGROUND OF THE INVENTION

Bags are widely used for a wide range of applications. In general, a bag comprises a body with a major storage space provided within. In addition, several minor storage compartments, such as pockets, can be provided within or around the bag to provide additional storage spaces for users to utilize. Unfortunately, even with the multiple storage spaces often provided in most bags, bags can be messy and unorganized for many people. Women typically have a messy purse bags or for travelers to have their luggage contents be disorganized after and during the trip, even if at the beginning all the contents were placed in an organized manner. Many devices and improvements for bags have been provided over the years to help users have better organized bags. However, the improvements to bags are very limited as these changes cannot meet the needs of most users. Likewise, most of the devices currently available to help organize bags are often designed for limited styles and sizes of bags and their functionality is often minimal. With the vast number of sizes and styles of bags, organizing devices should be flexible enough to be adjusted to the style, size, and style of the bag as well as be able to provide enough functionality to allow users to easily organize the contents of their bags and to easily retrieve the contents within the bag whenever they are needed. Unfortunately, most of the currently available devices and bags fail to provide these important aspects. Therefore, a device which can be used with any bag to help users organize the contents as well as to easily retrieve the contents is beneficial and necessary.

An objective of the present invention is to provide an organizing insert for bags. The present invention is designed to be placed inside a bag such as a purse, a briefcase, a travel bag of varying sizes, and so on. The present invention allows the contents of the bag to be organized and to be easily located when required for use. The user does not have to rummage or dig through all the contents of the bag to locate the item nor does the user need to dump out all the contents of the bag to search for a particular item such as a cellphone, keys or wallet. The present invention allows items to be organized instead of being all placed in a central storage area of the bag. The organizing insert protects items from being damaged or scratched as the organizing insert allows items to be stored separately from other items. The central appealing features of the present invention are the simplicity, practicality, convenience and ease of use. Use of the present invention reduces the time, energy and frustration associated with locating an item within a bag. Another important feature of the organizing insert is its ability to keep the shape of the bag. This makes the organizing insert attractive for use in accessory stores where the organizing insert can be used to enhance the aesthetics of displayed bags and offer a convenient and re-usable alternative to stuffing of bags.

DETAILED DESCRIPTION OF THE INVENTION

All illustrations of the drawings are for the purpose of describing selected versions of the present invention and are not intended to limit the scope of the present invention.

Figure 1:
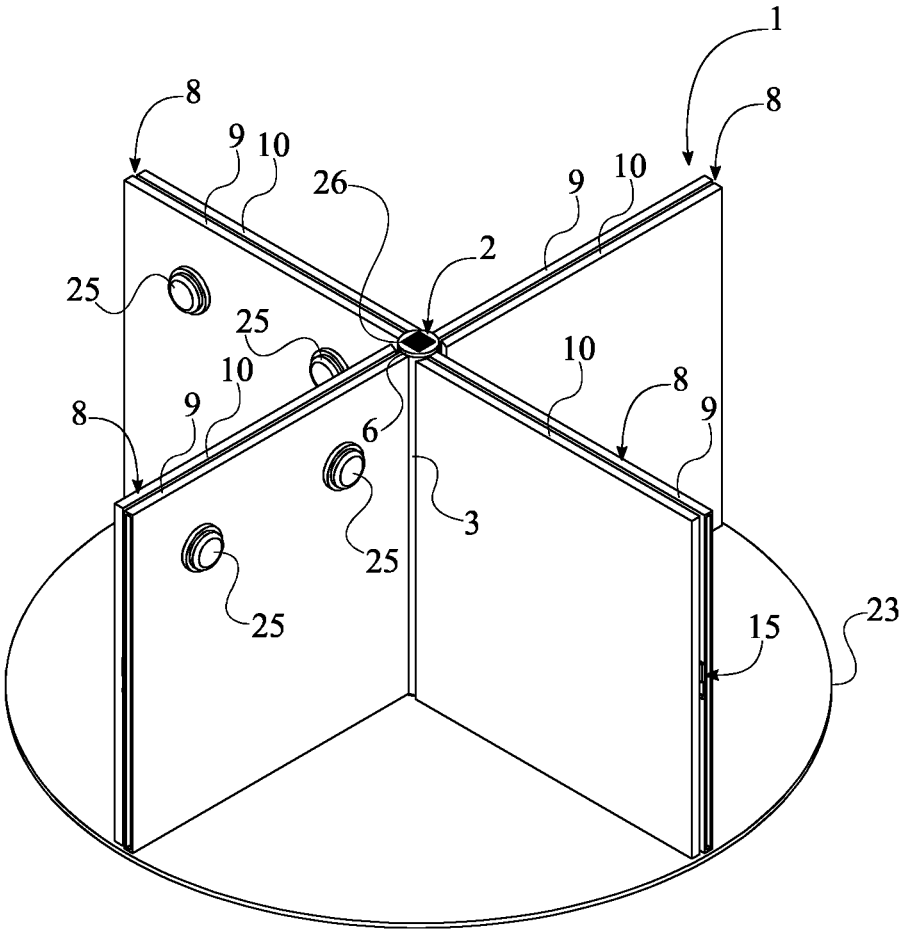
FIG. 1 is a perspective view of the present invention with a base plate and a plurality of telescopic dividers in a fully retracted configuration.

The present invention separates and divides the contents of a bag, thereby providing organization within the bag and facilitate the identification of each item within the bag. The present invention is universal, accommodating various sized and various shaped bags. In order for the present invention to define a plurality of compartments within a main compartment of a bag, the present invention comprises at least one organizing mechanism 1. The at least one organizing mechanism 1 comprises a central rod 2 and a plurality of telescopic dividers 8, seen in FIG. 1 and FIG. 2. The central rod 2 connects and orients the plurality of telescopic dividers 8. A compartment is defined between each of the plurality of telescopic dividers 8. The present invention is a universal organizer for bags as each of the plurality of telescopic dividers 8 comprises a fixed panel 9, a free panel 10, at least one first track 15, and at least one second track 18. The fixed panel 9 connects each telescopic divider of the plurality of telescopic dividers 8 with the central rod 2. The free panel 10 adjusts the length of each telescopic divider of the plurality of telescopic dividers 8. Consequently, the free panel 10 provides additional support to uphold and define the natural structure of the bag. More specifically, the fixed panel 9 and the free panel 10 each comprise a proximal edge 11, a distal edge 12, a first face 13, and a second face 14. The central rod 2 and the plurality of telescopic dividers 8 preferably comprise rigid and lightweight materials typically already part of a bag such as leather or plastic, however, alternate embodiments of the present invention may comprise metal materials or a variety of other rigid and lightweight materials.

The overall configuration of the aforementioned components allows the present invention to be integrated into a variety of bags and define a plurality of compartments. Each compartment is defined as the plurality of telescopic dividers 8 is radially distributed about the central rod 2, seen in FIG.

Figure 7:
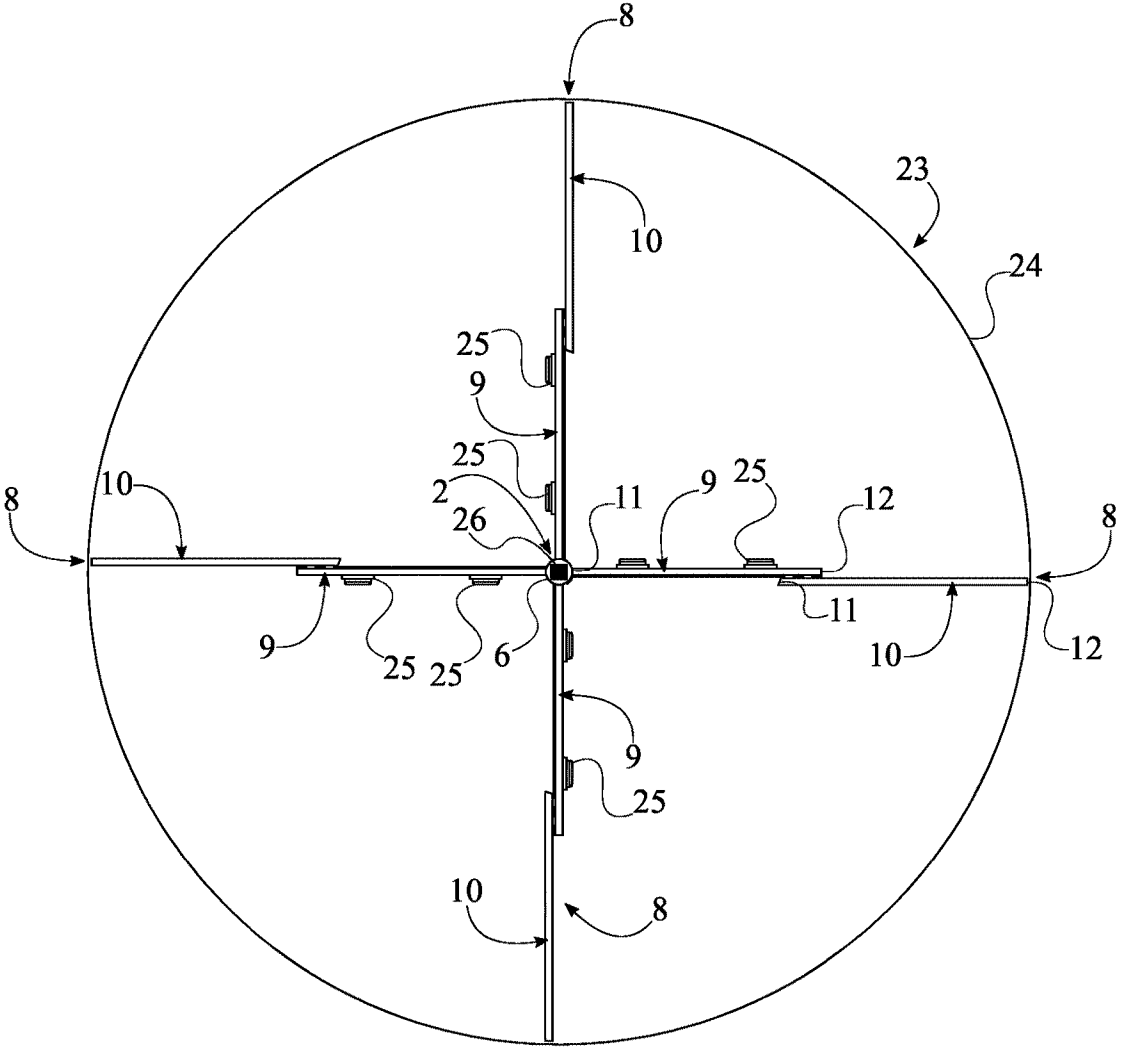
FIG. 7 is a top side view of the present invention with a first embodiment of the base plate and the plurality of telescopic dividers in a fully expanded configuration.

6 and FIG. 7. The number of compartments defined by the present invention is adjustable as the proximal edge 11 of the fixed panel 9 is laterally connected along the central rod 2. The at least one first track 15 is mounted across the first face 13 of the fixed panel 9 and traverses from the proximal edge 11 of the fixed panel 9 to the distal edge 12 of the fixed panel 9, seen in FIG. 2. This arrangement allows the free panel 10 to translate across the entirety of the fixed panel 9. Moreover, the at least one second track 18 is mounted across the second face 14 of the free panel 10 and traverses from the proximal edge 11 of the free panel 10 to the distal edge 12 of the free panel 10, structurally reinforcing the connection between the fixed panel 9 and the free panel 10 throughout use of the present invention. The at least one second track 18 is slidably engaged along the at least one first track 15 so that the free panel 10 continuously and smoothly translates across the fixed panel 9, allowing each telescopic divider of the plurality of telescopic dividers 8 to be in a retracted configuration and an expanded configuration.

The present invention further comprises a base plate 23, seen in FIG. 1, FIG. 2, FIG. 3, FIG. 4, FIG. 6, and FIG. 7. The base plate 23 upholds items with each compartment defined by the plurality of telescopic dividers 8 and preferably comprises leather materials. The base plate 23 is terminally attached to the central rod 2 such that the base plate 23 is positioned adjacent and across a base surface of a bag. Moreover, the central rod 2 is preferably centrally positioned with the base plate 23, equally dividing the main compartment of the bag.

Figure 2:
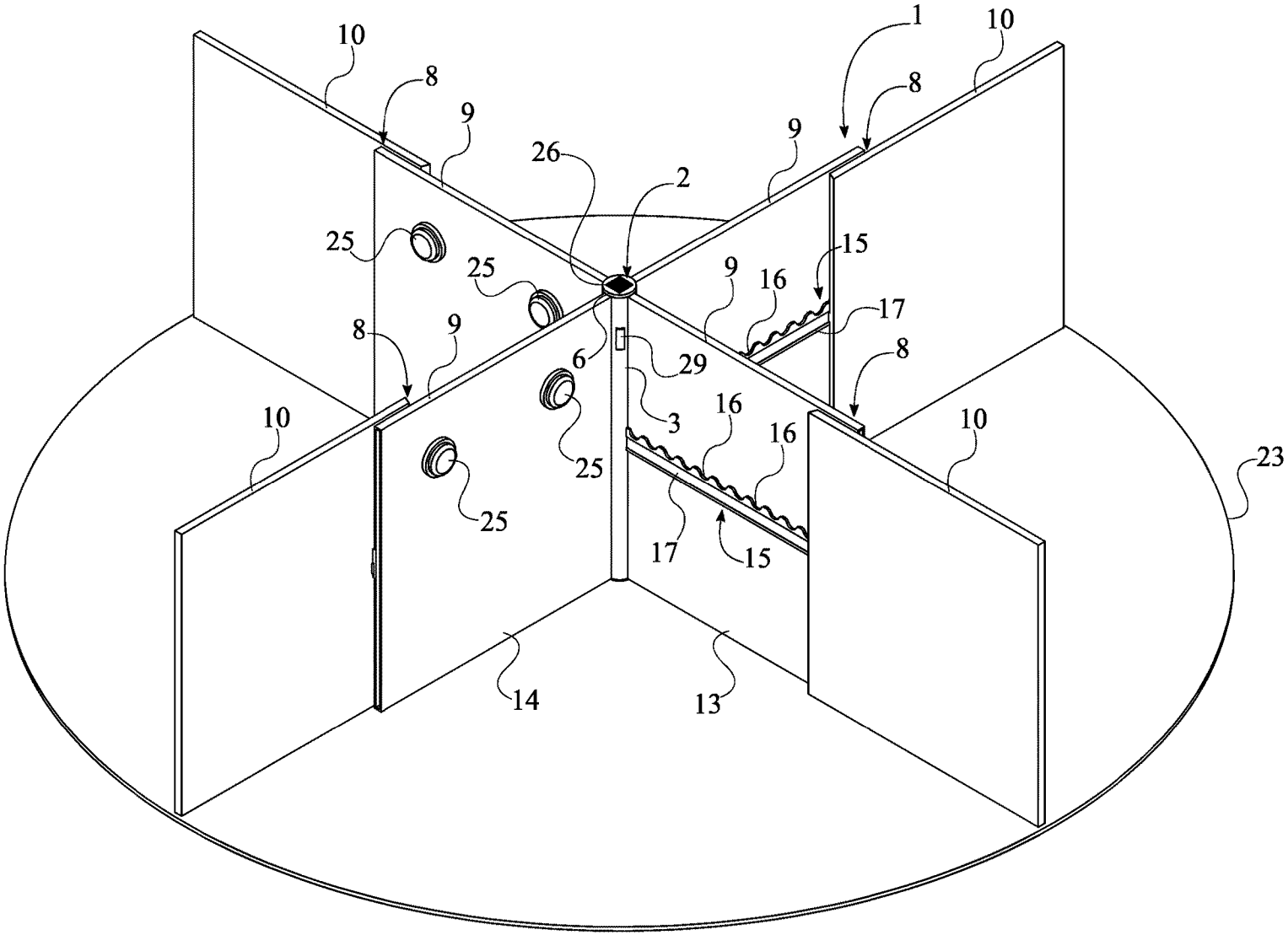
FIG. 2 is a perspective view of the present invention with the base plate and the plurality of telescopic dividers in a fully expanded configuration.
Figure 3:
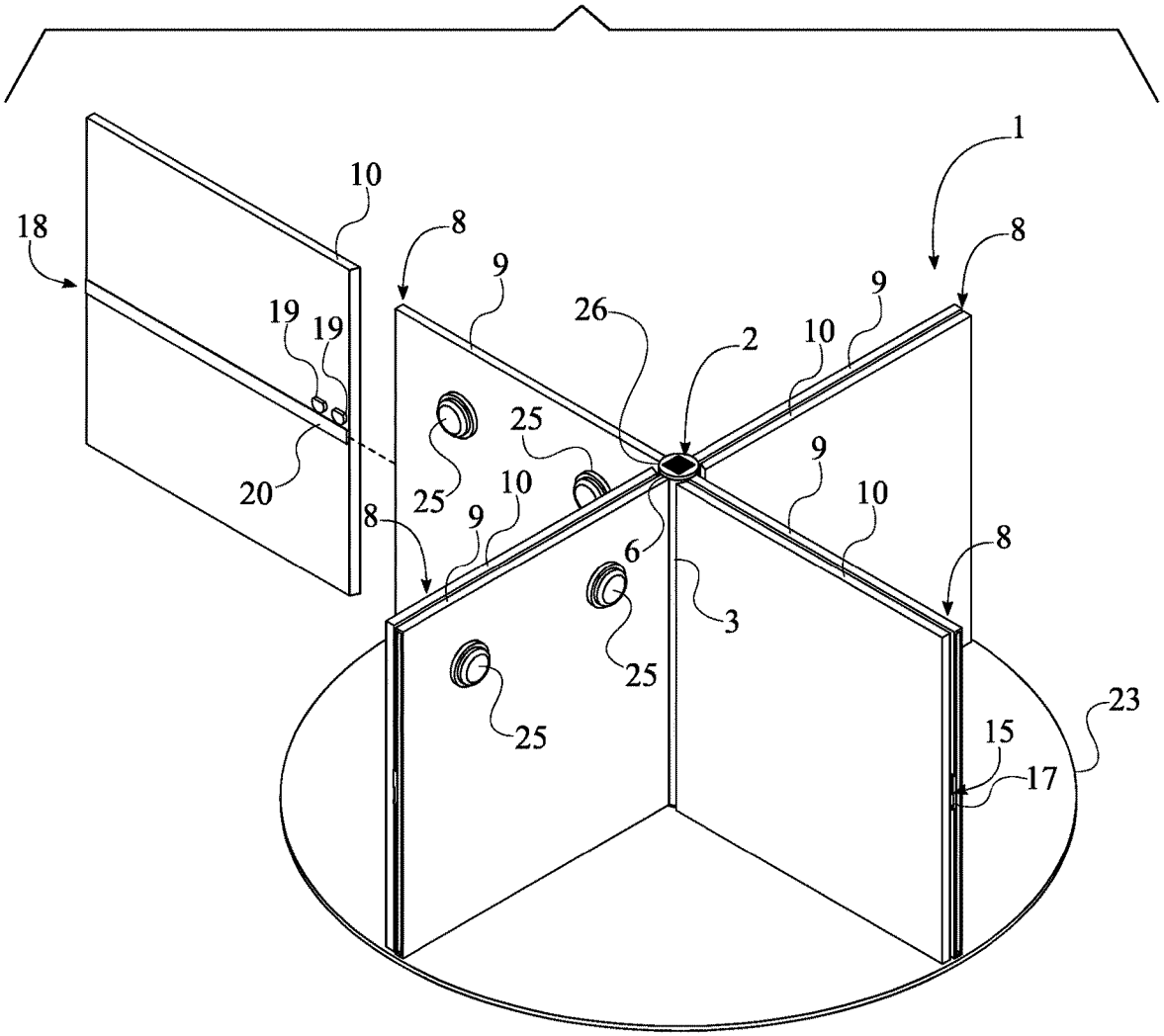
FIG. 3 is an exploded perspective view of the present invention with a fixed plate of a telescopic divider separated with a free plate of the corresponding telescopic divider in order to expose the at least one second track.
Figure 4:
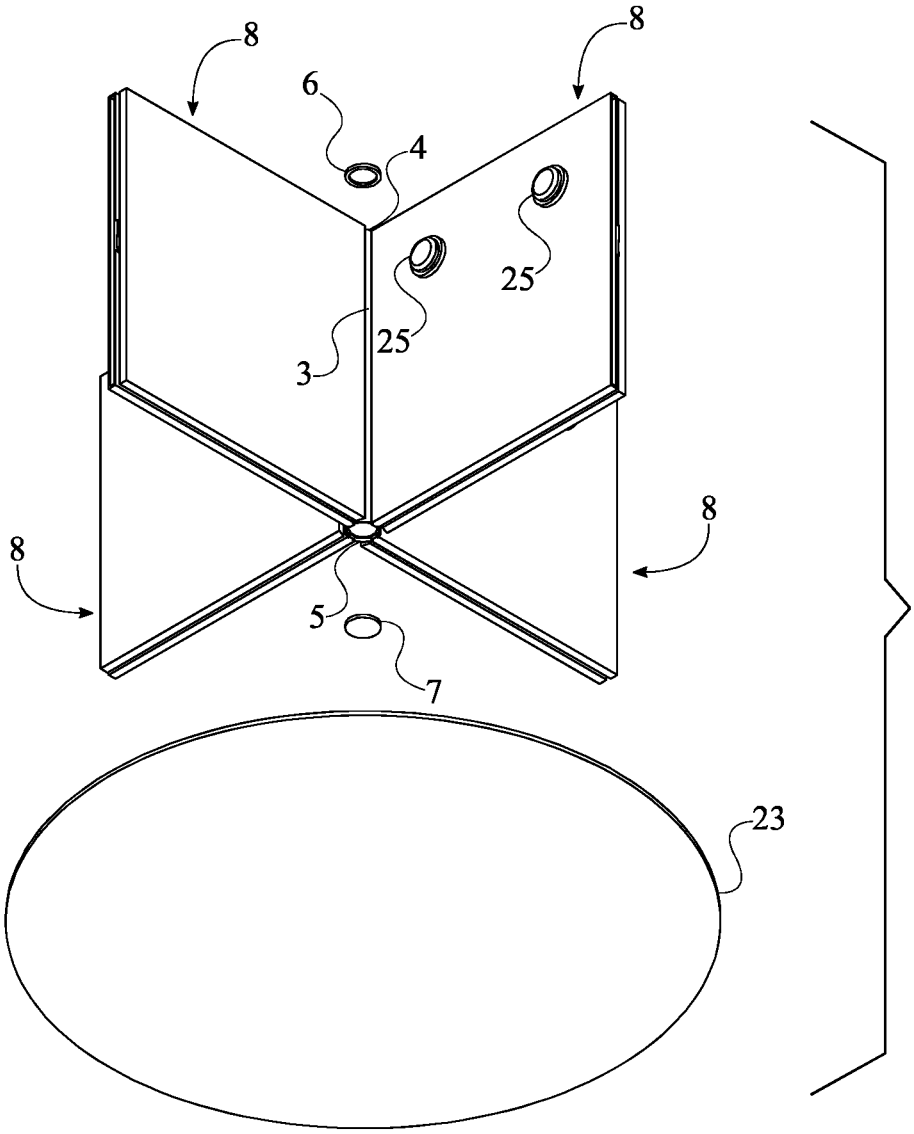
FIG. 4 is an exploded view of the central rod for the at least one organizing mechanism of the present invention.
Figure 5:
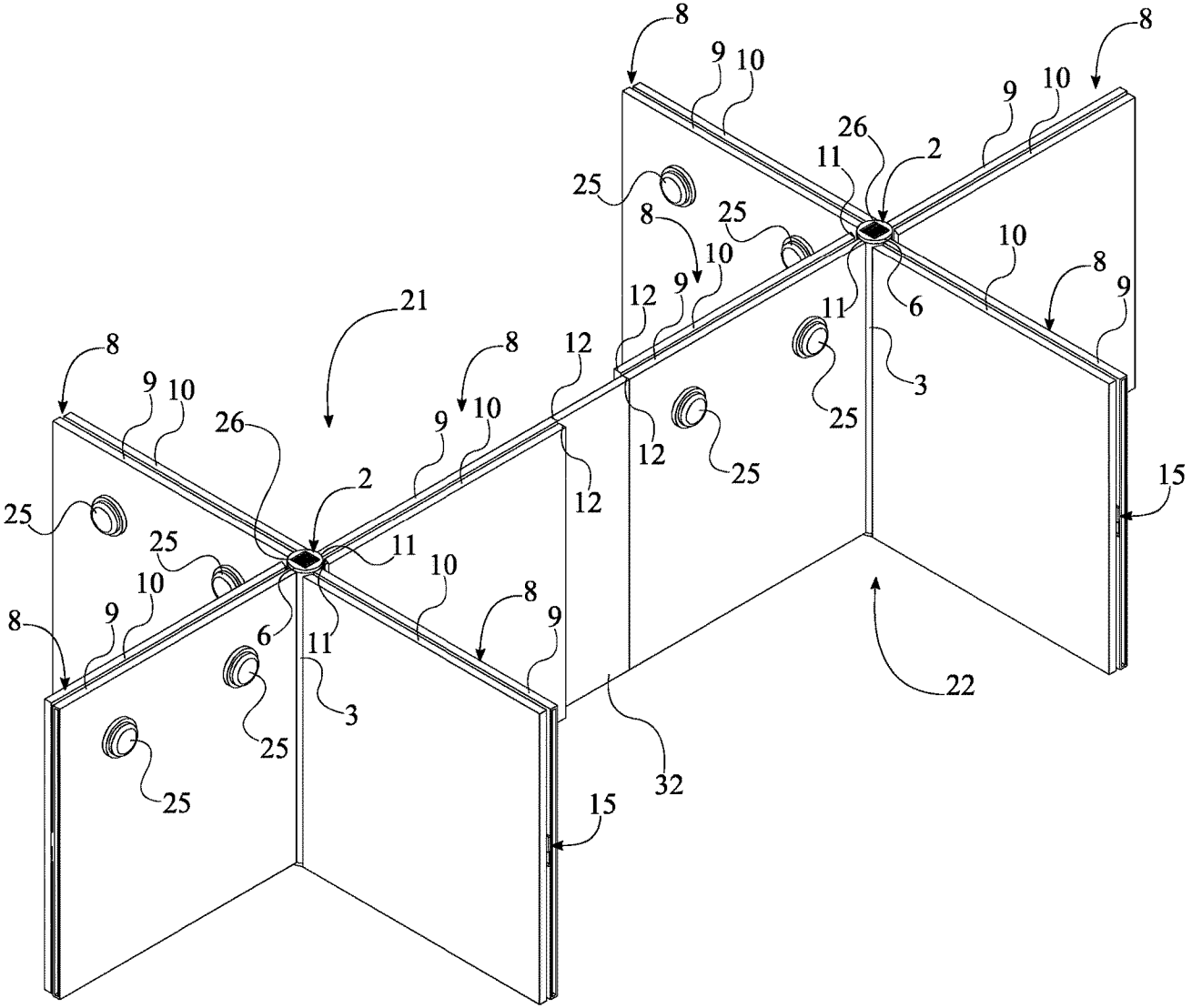
FIG. 5 is a perspective view of a first organizing mechanism and a second organizing mechanism of the present invention.
Figure 6:
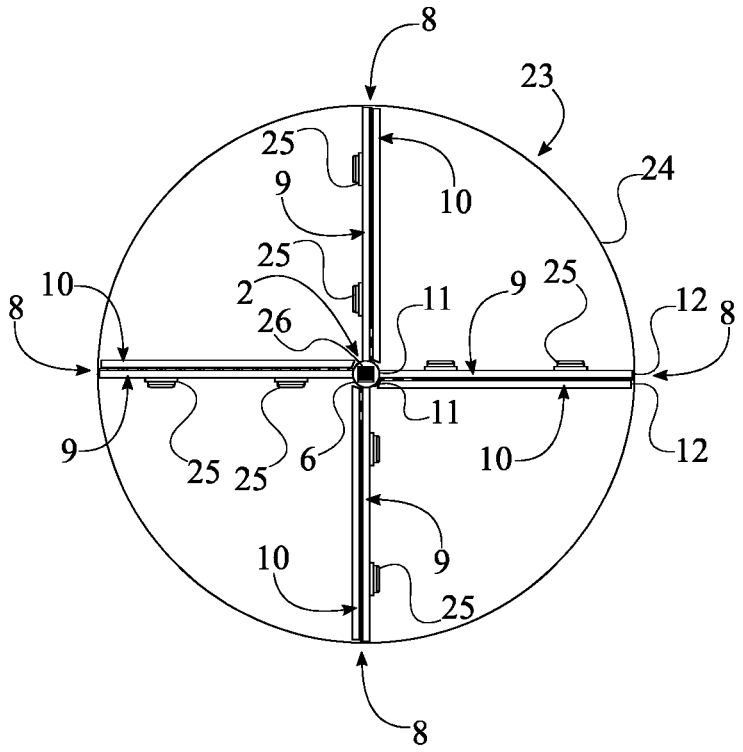
FIG. 6 is a top side view of the present invention with a second embodiment of the base plate and the plurality of telescopic dividers in the fully retracted configuration.

In a first embodiment of the present invention, the base plate 23 accommodates a bag with a large bottom surface and upholds items within the compartments defined by the plurality of telescopic dividers 8 in an expanded configuration, shown in FIG. 2. In this first embodiment of the present invention, the distal edge 12 of the fixed panel 9 is positioned in between the central rod 2 and the distal edge 12 of the free panel 10. The distal edge 12 of the free panel 10 is positioned adjacent to an outer edge 24 of the base plate 23, thereby accommodating the items positioned within the entire compartment defined by both the fixed panel 9 and the free panel 10. In a second embodiment of the present invention, the base plate 23 accommodates a bag with a small bottom surface and upholds items within compartments defined by the plurality of items within the compartments defined by the plurality of telescopic dividers 8 in a retracted configuration. In this second embodiment of the present invention, shown in FIG. 1, the distal edge 12 of the fixed panel 9 is positioned adjacent to an outer edge 24 of the base plate 23. The distal edge 12 of the free panel 10 is positioned offset from the outer edge 24 of the base place, thereby accommodating items positioned within the compartment defined by the fixed panel 9 while allowing the free panel 10 to press against and support the walls of a bag.

The preferred embodiment of the present invention further comprises at least one light source 25, a light sensor 26, a portable power source 27, and a switch 28, seen in FIG. 1, FIG. 2, FIG. 3, FIG. 4, FIG. 5, FIG. 6, FIG. 7, and FIG. 10. In order to facilitate the identification of an item within a compartment defined by the present invention, the at least one light source 25 provides illumination within the bag where light is typically limited. The light sensor 26 automatically detects the lack of light within the bag and turns on the at least one light source 25. The portable power source 27 provides the necessary power to the at least one light source 25 and is preferably a battery. The switch 28 controls the distribution of power from the power source to the at least one light source 25. In order to contain the portable power source 27 and the switch 28, the central rod 2 comprises a tubular body 3, a first cap 6, and a second cap 7. The tubular body 3 houses the portable power source 27 and the switch 28. The first cap 6 positioned and connects the light sensor 26 with the central rod 2. The second cap 7 allows a user to access and replace the portable power source 27 within the tubular body 3. The first cap 6 is attached around a first rim 4 of the tubular body 3. Similarly, the second cap 7 is attached around a second rim 5 of the tubular body 3. The at least one light source 25 is externally integrated with the second face 14 of the fixed panel 9 such that the at least one light source 25 is not inhibited by the free panel 10 and the free panel 10 continuously and smoothly translates across the fixed panel 9. In order for the light source to accurately detect a need for illumination within the bag, the light sensor 26 is externally mounted onto the first cap 6, which is oriented towards an opening of the bag. The portable power source 27 is positioned within the tubular body 3 containing and housing the mechanism which delivers power to the at least one light source 25. Moreover, the portable power source 27 is electrically connected to the at least one light source 25 through the switch 28, and the light sensor 26 is electronically connected to the switch 28.

The illumination of the at least one light source 25 is manually controlled as the present invention further comprise a manual toggle 29, seen in FIG. 7. The manual toggle 29 allows the at least one light source 25 to turn on and turn off regardless of the detection of lack of light within the bag by the light sensor 26. The manual toggle 29 is preferably a flip switch 28 that is easily accessible by a user. In order for the manual toggle 29 to be easily accessible, the manual toggle 29 is laterally mounted to the central rod 2. The manual toggle 29 is operatively coupled to the switch 28, wherein the manual toggle 29 is used to open and close the switch 28, thereby preventing the at least one light source 25 from automatically turning on.

Figure 8:
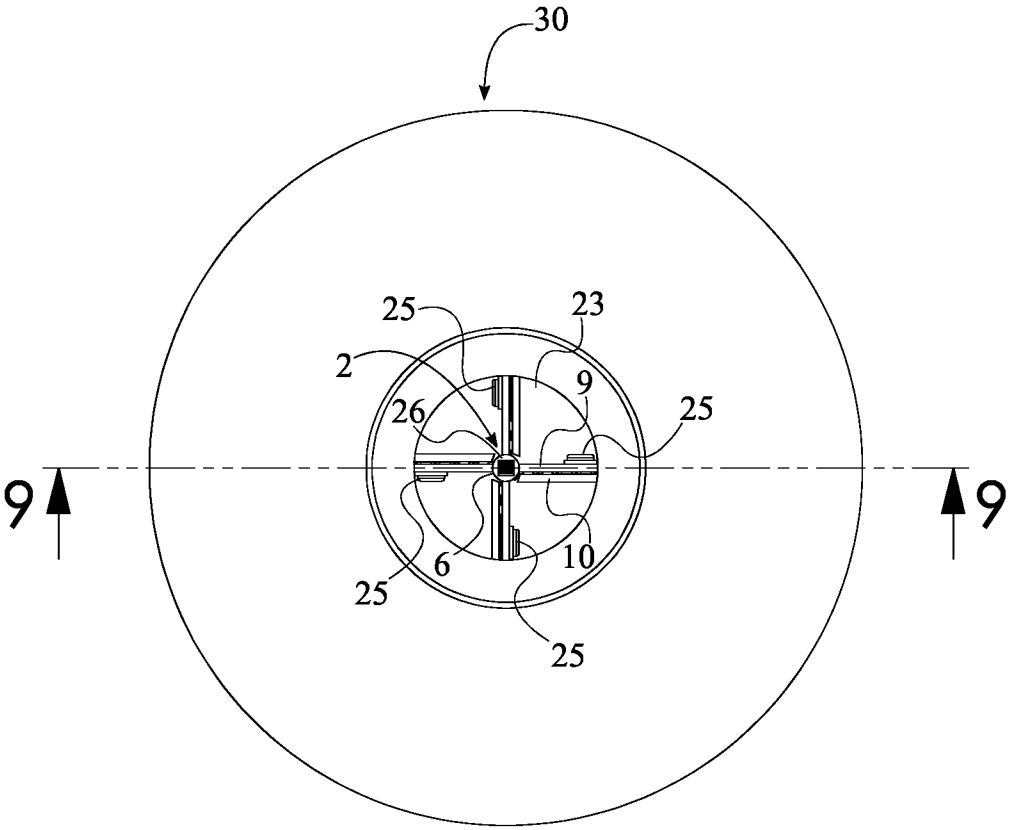
FIG. 8 is a top side view of the present invention with the central rod, the plurality of telescopic dividers, and the base positioned within a supplementary pouch.
Figure 9:
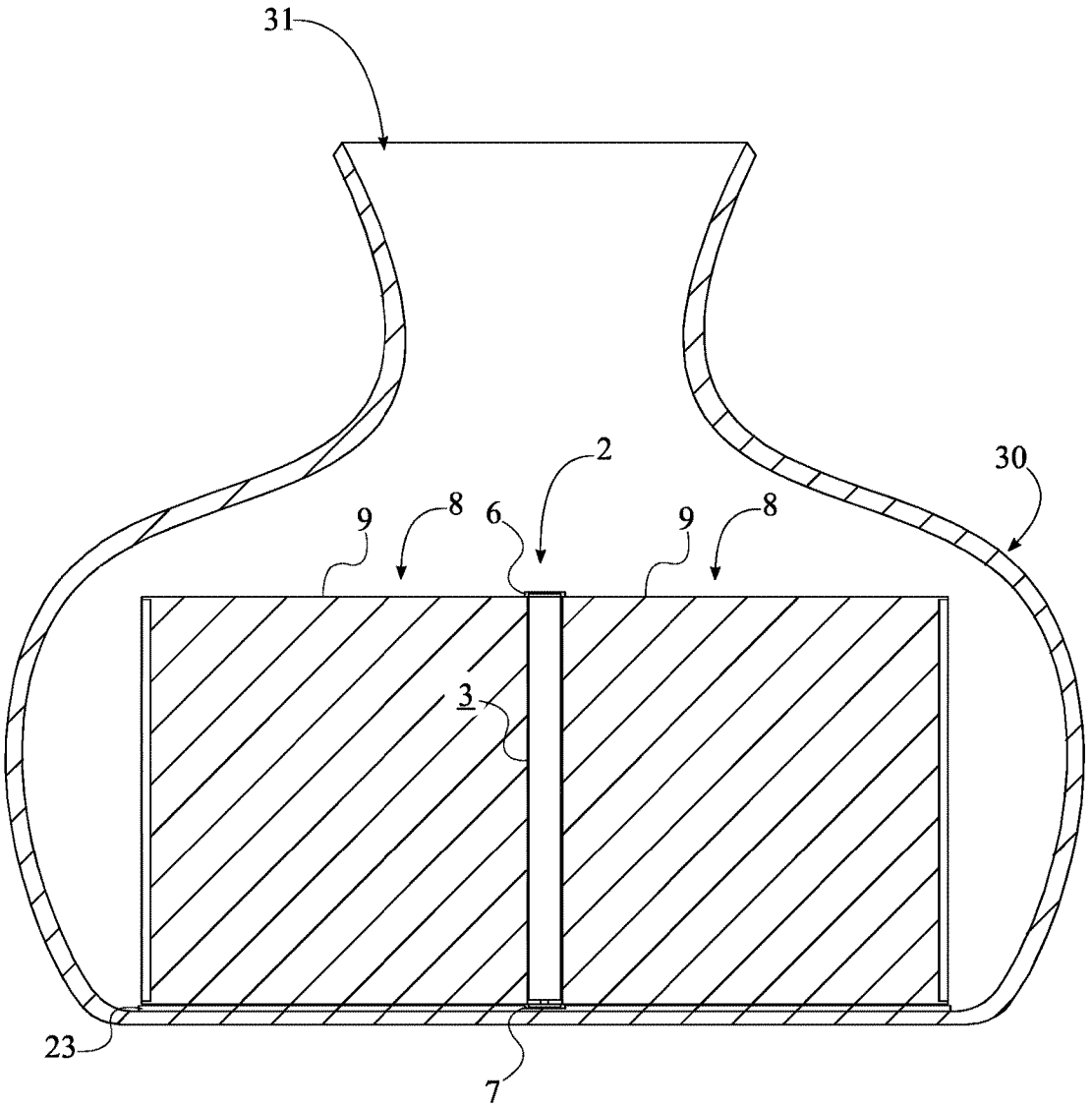
FIG. 9 is a cross-section view of FIG. 8 along line 9-9 of the present invention.
Figure 10:
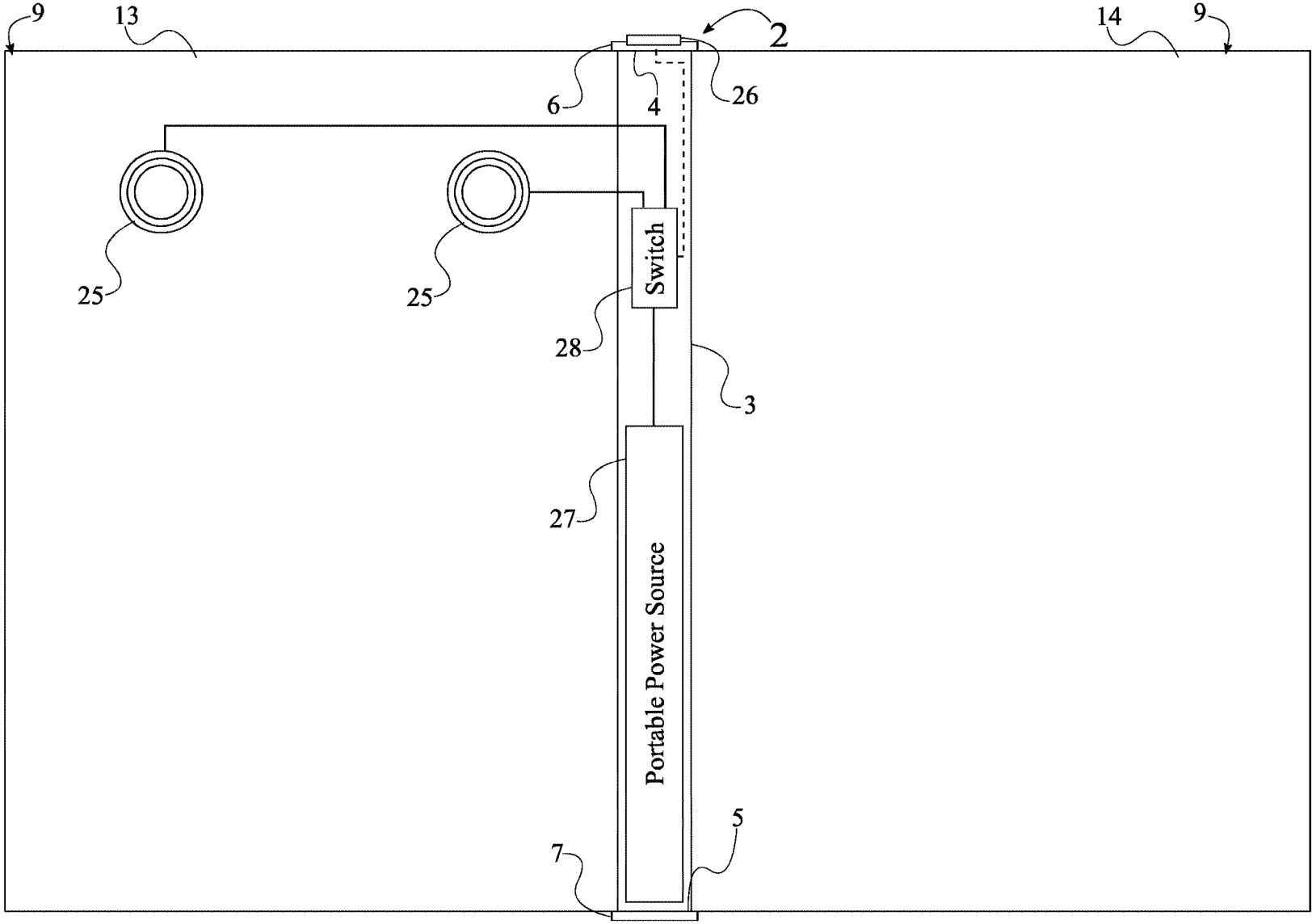
FIG. 10 is a schematic view of the electronic and electrical connections of the present invention.

The present invention further facilitates the organization of items while transporting items from a bag to another bag as the present invention further comprises a supplementary pouch 30, illustrated in FIG. 8 and FIG. 9. The supplementary pouch 30 surrounds items within each compartment defined by the plurality of telescopic dividers 8. Moreover, the central rod 2 and the plurality of telescopic dividers 8 are positioned within the supplementary pouch 30. In order for the light sensor 26 to effectively activate and deactivate the at least one light source 25, the light sensor 26 is oriented towards an opening 31 of the supplementary pouch 30.

The present invention accommodates both various sized and various shaped bags. The present invention accommodates various shaped bags specifically, as the present invention further comprises an interconnecting panel 32, and the at least one organizing mechanism 1 comprises a first organizing mechanism 21 and a second organizing mechanism 22. The interconnecting panel 32, seen in FIG. 5, allows the first organizing mechanism 21 and the second organizing mechanism 22 to be connected with one another and positioned the first organizing mechanism 21 beside the second organizing mechanism 22. The first organizing mechanism 21 and the second organizing mechanism 22 accommodates bags with a base surface in a rectangular-like shape. In order to preserve the compartments defined by the plurality of telescopic dividers 8, the interconnecting panel 32 is positioned in between the fixed panel 9 of the first organizing mechanism 21 and the fixed panel 9 of the second organizing mechanism 22. The interconnecting panel 32 is preferably oriented parallel and coplanar with the fixed panel 9 of the first organizing mechanism 21 and the fixed panel 9 of the second organizing mechanism 22, thereby accommodating bags with an elongated base surface. The distal edge 12 of the first organizing mechanism 21 and the distal edge 12 of the fixed panel 9 of the second organizing mechanism 22 are removably mounted with each other with the interconnecting panel 32. This arrangement allows the first organizing mechanism 21 and the second organizing mechanism 22 to be attached and detached from each other, further enhancing the universality of the present invention.

In order to secure and define each compartment, the at least one first track 15 comprises a plurality of notches 16 and an at least one first track body 17. Similarly, the at least one second track 18 comprises at least one tab 19 and at least one second track body 20, seen in FIG. 3. The plurality of notches 16 and the at least one tab 19 secures the desired position of the free panel 10 across the fixed panel 9. The at least one first track body 17 and the at least one second track body 20 allows the free panel 10 to translate across the fixed panel 9 while remaining connected with the fixed panel 9. The plurality of notches 16 is laterally connected to and is distributed along the at least one first track body 17. Similarly, the at least one tab 19 is laterally connected to the at least one second track body 20. A desired position of the free panel 10 is secured as an at least one selected notch from the plurality of notches 16 is engaged by the at least one tab 19.

The preferred embodiment of the present invention, whether engaged with the base plate 23 or the first organizing mechanism 21 and the second organizing mechanism 22 being connected with the interconnecting panel 32, is easily removed from one bag and integrated into another with the supplementary pouch 30. Seen in FIG. 8 and FIG. 9, the supplementary pouch 30 preserves the organization of items within the bag throughout transportation. Moreover, the central rod 2 and the plurality of telescopic dividers 8 are positioned within the supplementary pouch 30.

Although the invention has been explained in relation to its preferred embodiment, it is to be understood that many other possible modifications and variations can be made without departing from the spirit and scope of the invention as hereinafter claimed.

What is claimed is:

1. A customizable bag organizer comprises:

at least one organizing mechanism;

the at least one organizing mechanism comprises a central rod and a plurality of telescopic dividers;

each of the plurality of telescopic dividers comprises a fixed panel, a free panel, a at least one first track, and a at least one second track;

the fixed panel and the free panel each comprise a proximal edge, a distal edge, a first face, and a second face;

the plurality of telescopic dividers being radially distributed about the central rod;

the proximal edge of the fixed panel being laterally connected along the central rod;

the at least one first track being mounted across the first face of the fixed panel;

the at least one first track traversing from the proximal edge of the fixed panel to the distal edge of the fixed panel;

the at least one second track being mounted across the second face of the free panel;

the at least one second track traversing from the proximal edge of the free panel to the distal edge of the free panel; and, the at least one second track being slidably engaged along the at least one first track.

2. The customizable bag organizer as claimed in claim 1 comprises:

a base plate;

the base plate being terminally attached to the central rod; and, the central rod being centrally positioned with the base plate.

3. The customizable bag organizer as claimed in claim 2 comprises:

the distal edge of the fixed panel being positioned in between the central rod and the distal edge of the free panel; and, the distal edge of the free panel being positioned adjacent to an outer edge of the base plate.

4. The customizable bag organizer as claimed in claim 2 comprises:

the distal edge of the fixed panel being positioned adjacent to an outer edge of the base plate; and, the distal edge of the free panel being positioned offset from the outer edge of the base plate.

5. The customizable bag organizer as claimed in claim 1 comprises:

at least one light source;

a light sensor;

a portable power source;

a switch;

the central rod comprises a tubular body, a first cap, and a second cap;

the first cap being attached around a first rim of the tubular body;

the second cap being attached around a second rim of the tubular body;

the at least one light source being externally integrated with the second face of the fixed panel;

the light sensor being externally mounted onto the first cap;

the portable power source being positioned within the tubular body;

the portable power source being electrically connected to the at least one light source through the switch; and, the light sensor being electronically connected to the switch.

6. The customizable bag organizer as claimed in claim 5 comprises:

a manual toggle;

the manual toggle being laterally mounted to the central rod; and, the manual toggle being operatively coupled to the switch, wherein the manual toggle is used to open and close the switch.

7. The customizable bag organizer as claimed in claim 5 comprises:

a supplementary pouch;

the central rod and the plurality of telescopic dividers being positioned within the supplementary pouch; and, the light sensor being oriented towards an opening of the supplementary pouch.

8. The customizable bag organizer as claimed in claim 1 comprises:

an interconnecting panel;

the at least one organizing mechanism comprises a first organizing mechanism and a second organizing mechanism;

the interconnecting panel being positioned in between the fixed panel of the first organizing mechanism and the fixed panel of the second organizing mechanism;

the interconnecting panel being oriented parallel and coplanar with the fixed panel of the first organizing mechanism and the fixed panel of the second organizing mechanism; and, the distal edge of fixed panel of the first organizing mechanism and the distal edge of the fixed panel of the second organizing mechanism being removably mounted with each other with the interconnecting panel.

9. The customizable bag organizer as claimed in claim 1 comprises:

the at least one first track comprises a plurality of notches and an at least one first track body;

the at least one second track comprises at least one tab and an at least one second track body;

the plurality of notches being laterally connected to the at least one first track body;

the plurality of notches being distributed along the at least one first track body;

the at least one tab being laterally connected to the at least one second track body; and, an at least one selected notch from the plurality of notches being engaged by the at least one tab.

10. The customizable bag organizer as claimed in claim 1 comprises:

a supplementary pouch; and, the central rod and the plurality of telescopic dividers being positioned within the supplementary pouch.

11. A customizable bag organizer comprises:

at least one organizing mechanism;

at least one light source;

a light sensor;

a portable power source;

a switch;

the at least one organizing mechanism comprises a central rod and a plurality of telescopic dividers;

each of the plurality of telescopic dividers comprises a fixed panel, a free panel, a at least one first track, and a at least one second track;

the fixed panel and the free panel each comprise a proximal edge, a distal edge, a first face, and a second face;

the central rod comprises a tubular body, a first cap, and a second cap;

the plurality of telescopic dividers being radially distributed about the central rod;

the proximal edge of the fixed panel being laterally connected along the central rod;

the at least one first track being mounted across the first face of the fixed panel;

the at least one first track traversing from the proximal edge of the fixed panel to the distal edge of the fixed panel;

the at least one second track being mounted across the second face of the free panel;

the at least one second track traversing from the proximal edge of the free panel to the distal edge of the free panel;

the at least one second track being slidably engaged along the at least one first track;

the first cap being attached around a first rim of the tubular body;

the second cap being attached around a second rim of the tubular body;

the at least one light source being externally integrated with the second face of the fixed panel;

the light sensor being externally mounted onto the first cap;

the portable power source being positioned within the tubular body;

the portable power source being electrically connected to the at least one light source through the switch; and, the light sensor being electronically connected to the switch.

12. The customizable bag organizer as claimed in claim 11 comprises:

a base plate;

the base plate being terminally attached to the central rod; and, the central rod being centrally positioned with the base plate.

13. The customizable bag organizer as claimed in claim 12 comprises:

the distal edge of the fixed panel being positioned in between the central rod and the distal edge of the free panel; and, the distal edge of the free panel being positioned adjacent to an outer edge of the base plate.

14. The customizable bag organizer as claimed in claim 12 comprises:

the distal edge of the fixed panel being positioned adjacent to an outer edge of the base plate; and, the distal edge of the free panel being positioned offset from the outer edge of the base plate.

15. The customizable bag organizer as claimed in claim 11 comprises:

a manual toggle;

the manual toggle being laterally mounted to the central rod; and, the manual toggle being operatively coupled to the switch, wherein the manual toggle is used to open and close the switch.

16. The customizable bag organizer as claimed in claim 11 comprises:

a supplementary pouch;

the central rod and the plurality of telescopic dividers being positioned within the supplementary pouch; and, the light sensor being oriented towards an opening of the supplementary pouch.

17. The customizable bag organizer as claimed in claim 11 comprises:

an interconnecting panel;

the at least one organizing mechanism comprises a first organizing mechanism and a second organizing mechanism;

the interconnecting panel being positioned in between the fixed panel of the first organizing mechanism and the fixed panel of the second organizing mechanism;

the interconnecting panel being oriented parallel and coplanar with the fixed panel of the first organizing mechanism and the fixed panel of the second organizing mechanism; and, the distal edge of fixed panel of the first organizing mechanism and the distal edge of the fixed panel of the second organizing mechanism being removably mounted with each other with the interconnecting panel.

18. The customizable bag organizer as claimed in claim 11 comprises:

the at least one first track comprises a plurality of notches and an at least one first track body;

the at least one second track comprises at least one tab and an at least one second track body;

the plurality of notches being laterally connected to the at least one first track body;

the plurality of notches being distributed along the at least one first track body;

the at least one tab being laterally connected to the at least one second track body; and, an at least one selected notch from the plurality of notches being engaged by the at least one tab.

19. The customizable bag organizer as claimed in claim 11 comprises:

a supplementary pouch; and, the central rod and the plurality of telescopic dividers being positioned within the supplementary pouch.

* * * * *